United States Patent [19]

Fenner et al.

[11] Patent Number: 4,643,087

[45] Date of Patent: Feb. 17, 1987

[54] PROCESS FOR MONITORING THE FULLNESS OF A COMPACTOR

[75] Inventors: Gordon H. Fenner, Columbus, Miss.; Ronald L. Brown, Vernon, Ala.

[73] Assignee: Marathon Corporation, Birmingham, Ala.

[21] Appl. No.: 815,910

[22] Filed: Jan. 3, 1986

Related U.S. Application Data

[62] Division of Ser. No. 631,998, Jul. 18, 1984.

[51] Int. Cl.[4] ..... B30B 1/32

[52] U.S. Cl. ..... 100/35; 100/50; 100/99; 100/229 A; 100/269 R

[58] Field of Search ..... 100/35, 41, 48, 50, 100/229 A, 99, 269 R

[56] References Cited

U.S. PATENT DOCUMENTS

| | | | |
|---|---|---|---|
| 3,005,403 | 10/1961 | Van Endert | 100/269 R X |
| 3,250,414 | 5/1966 | Pioch | 100/50 X |
| 3,336,861 | 8/1967 | Clar | 100/50 X |
| 3,384,007 | 5/1968 | Boje | 100/229 A |
| 3,534,678 | 10/1970 | Clar | 100/50 |
| 3,787,830 | 1/1974 | Cato | 100/99 X |
| 4,184,424 | 1/1980 | Yeager | 100/99 X |

*Primary Examiner*—Billy J. Wilhite

*Attorney, Agent, or Firm*—Shlesinger, Arkwright, Garvey & Fado

[57] ABSTRACT

A system for monitoring the fullness of a compactor waste receiving container utilizes the back pressure generated by the compacted waste for determining the fullness of the container. The compactor ram is stopped when in the forward compacting position and the pressure exerted by the waste on the ram is monitored for thereby determining the fullness of the container. The system further includes a timer for monitoring the time required for displacement of the ram. Should the ram fail to attain the waste compacted position within a pre-determined time period then the hydraulic system is shut down and an indicator is lit in order to show to the operator that the container is full.

16 Claims, 5 Drawing Figures

PROCESS FOR MONITORING THE FULLNESS OF A COMPACTOR

This is a division of application Ser. No. 631,998, filed July 18, 1984.

BACKGROUND OF THE INVENTION

The utilization of compactors for compressing waste into an economically manageable size is known from the prior art. The compaction of waste is economically advantageous because the reduced volume permits more waste to be stored in a single container with the result that collection of the waste may be performed as required or at relatively infrequent intervals. The compaction of waste, therefore, permits the waste storage facility to be relatively small and also aesthetically pleasing. Another advantage is that the waste-receiving containers are more hygienic and aesthetically attractive than open air facilities.

Compactors are sized from relatively small units which are utilized in the home to large scale industrial systems. Regardless of size, however, the typical compactor utilizes a displaceable ram for compressing the waste into a reduced volume. Generally, a hydraulically operated cylinder and piston assembly is connected to the ram for reciprocally displaoing the ram between a waste-receiving and a waste-compressed position. In the larger units, the compressed waste holding container is separable from the ram unit in order to permit changing of the containers as they are filled.

Frequently, the user of the compactor utilizes a waste hauler for the purpose of changing the filled container. Naturally, the cost of changing the containers will be related to the number of containers which are changed. Consequently, it is economically advantageous for the user of the compactor to utilize the services of the hauler only at such times as when the compactor is full. Conventional compactors, including the containers therefor, fail to provide any indication of when the container is approaching fullness. Therefore, the user must estimate the amount of waste which is contained therein if he is to minimize his hauling costs. Accurate estimates are particularly needed when holidays and other extended gaps in hauling service are encountered.

Cato, et al., U.S. Pat. No. 3,787,830, discloses an apparatus for indicating when a roll-off container is filled. A particular disadvantage of the Cato system is that the pressure-actuated device is secured in the container wherein it is exposed to the refuse. This location is disadvantageous due to the fact that the mechanism may become jammed with refuse. Furthermore, accessibility is severely restricted, with the result that each container requires a separate system and means must be provided for connection with the mechanism.

Based upon the above, one skilled in the art can appreciate that a simple, reliable means for monitoring the fullness of a compactor container is advantageous. Such a monitor should be easily accessible and should not be exposed to contamination by refuse. The monitor, advantageously, should include means for indicating the relative fullness of the container and the indicator means should be capable of being remotely located from the container so to be visible to the operator of the compactor.

OBJECTS AND SUMMARY OF THE INVENTION

A primary object of the disclosed invention is to provide a process and apparatus for monitoring the fullness of a compactor waste container which may be remotely located and which is not exposed to the waste environment.

The process and apparatus of the disclosed invention provide a system for measuring the pressure exerted by the compacted refuse as a means for monitoring the fullness of the container. One skilled in the art realizes that compacted refuse, particularly as the container approaches fullness, generates a measureable pressure proportional to the degree of compaction. The degree of compaction is proportional to the fullness of the container, with the result that monitoring of this pressure permits an accurate estimate to be made of the available space remaining in the container.

The disclosed invention is advantageously utilized by locking the compaction ram in the forward waste-compacted position during the compaction stroke and by measuring the back pressure of the hydraulic cylinder generated by compacted waste bearing against the ram, and therefore compressing the fluid in the cylinder. The monitor is preferably only operable during such time that the hydraulic system is shut down or on idle, with the result that temporary blockages, such as those caused by boards and other hard incompressible objects, may be cleared without falsely indicating that the container is full. Because the hydraulic cylinder is utilized for monitoring the fullness, the system is not exposed to the environment of the container and is therefore easily accessible for maintenance and repair.

Another feature of the invention is the utilization of a timer for monitoring the time required to complete the compaction stroke. Should the compaction ram fail to attain the waste-compacted position in a pre-determined time period, then the hydraulic system will automatically shut down and the monitoring system will indicate that the container is full. This feature prevents the container from becoming jammed or clogged in the event that the container has not been emptied. One skilled in the art can appreciate that large expenditures of time and effort may be required to clear a container which has been overfilled to the extent of becoming jammed.

The disclosed invention is comparatively simple to construct and is easily adapted for utilization with most hydraulically operated compactors. The system provides a system of lights for indicating the degree of utilization or fullness of the container. The lights are located on a control panel so that the operator will know the amount of space remaining in the container prior to initiation of the operating cycle.

Advantageously, the compactor mechanism is provided with a form of gate valve. This feature provides that only a predetermined amount of refuse will be admitted into the compactor during the compaction cycle. Typically, a hopper is provided above the compactor mechanism and above the gate valve. The hopper temporarily stores the waste and operation of the ram causes a predetermined amount of waste to be received in and compacted by the ram, with the result that repeated operation of the ram may be necessary to compact all of the waste in the hopper. This feature, however, prevents the compactor from becoming jammed and thereby results in more efficient operation of the unit.

Consequently, those skilled in the art can appreciate that the disclosed invention provides a simple, yet reliable, system for monitoring the fullness of a compactor waste-receiving container. The closed container has a waste-receiving aperture therein and a compactor unit, including means for receiving waste to be compacted, is releaseably secured to the container in alignment with the aperture. A waste-compacting ram is aligned with the aperture and is adapted for being displaced between a first waste receiving position and a second waste compacted position adjacent the aperture.

A hydraulically operated cylinder and piston assembly is connected to the compacting unit and to the ram for reciprocally displacing the ram between the first and second positions. A hydraulic fluid supply system is connected to the cylinder and piston assembly and is adapted for supplying pressurized fluid thereto for thereby displacing the ram. A control system is connected to the fluid supply system and is adapted for interrupting the supply of pressurized fluid when the ram is in the second position. Fluid pressure-actuated switches are in fluid communication with the cylinder fluid and cooperate with the control system for monitoring the fluid pressure for a preselected time period when the ram is in the second position. The fluid pressure is generated by compacted waste bearing against the ram and thereby pressurizing the cylinder and piston assembly proportional to the fullness of the container. A signal system is connected with the fluid actuated switches for signaling the container fullness to the operator.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 3:
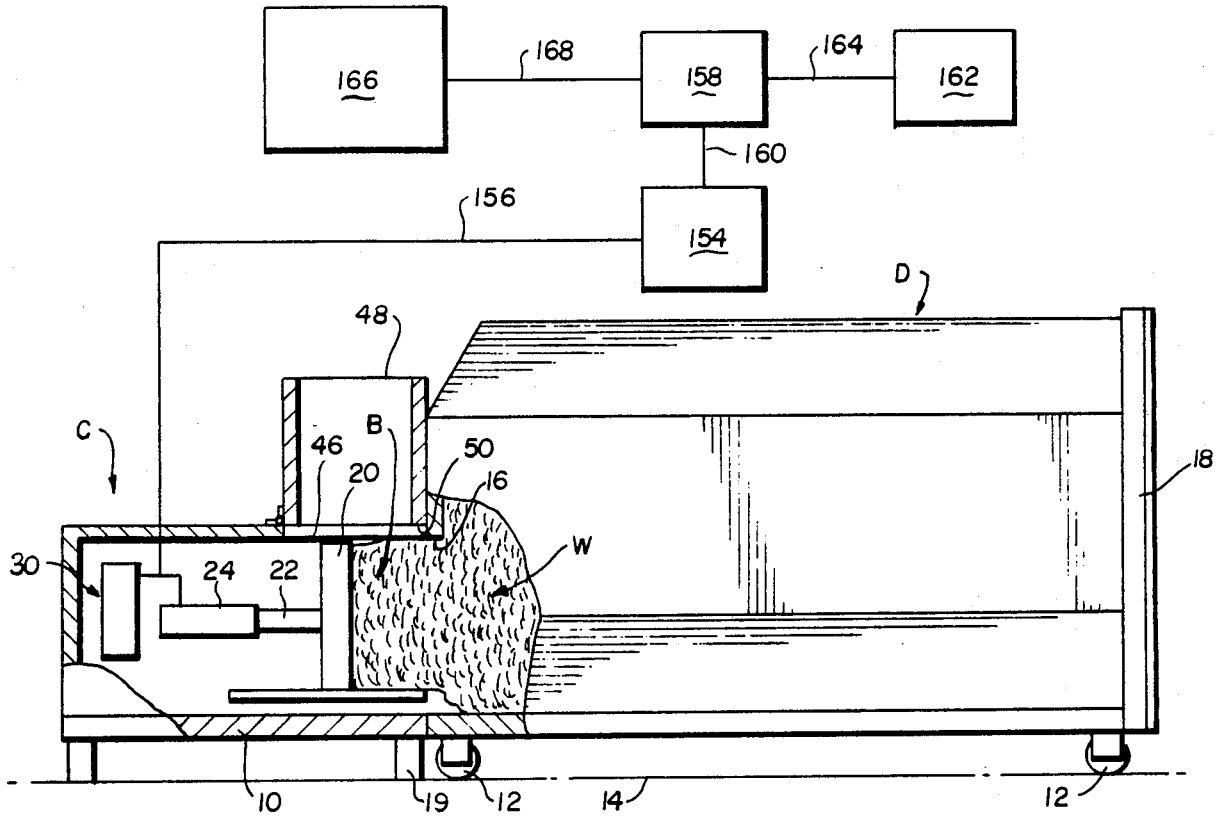
FIG. 3 is a side elevational view with portions broken away for clarity and a partial schematic view of the compactor and container of the invention.

As best shown in FIG. 3, a ground supported platform 10 has wheels 12 rotatably depending therefrom in order to permit movement of platform 10 on surface 14. Compactor unit C is supported by legs 19 on surface 14. Container D is securely mounted atop platform 10 in alignment with compactor unit C. Preferably container D is of the roll-on/roll-off type and is releaseably secured to compactor unit C. Container D has a waste receiving aperture 16 in alignment with the open end of compactor unit C, for reasons to be explained herein later. Container D may be rectangularly shaped, or otherwise shaped, and includes an access door 18 permitting removal of waste W from the container D. While the compactor unit C is disclosed as having a removable container, those skilled in the art will appreciate that the invention may be practiced with a fixed container as well.

Figure 1:
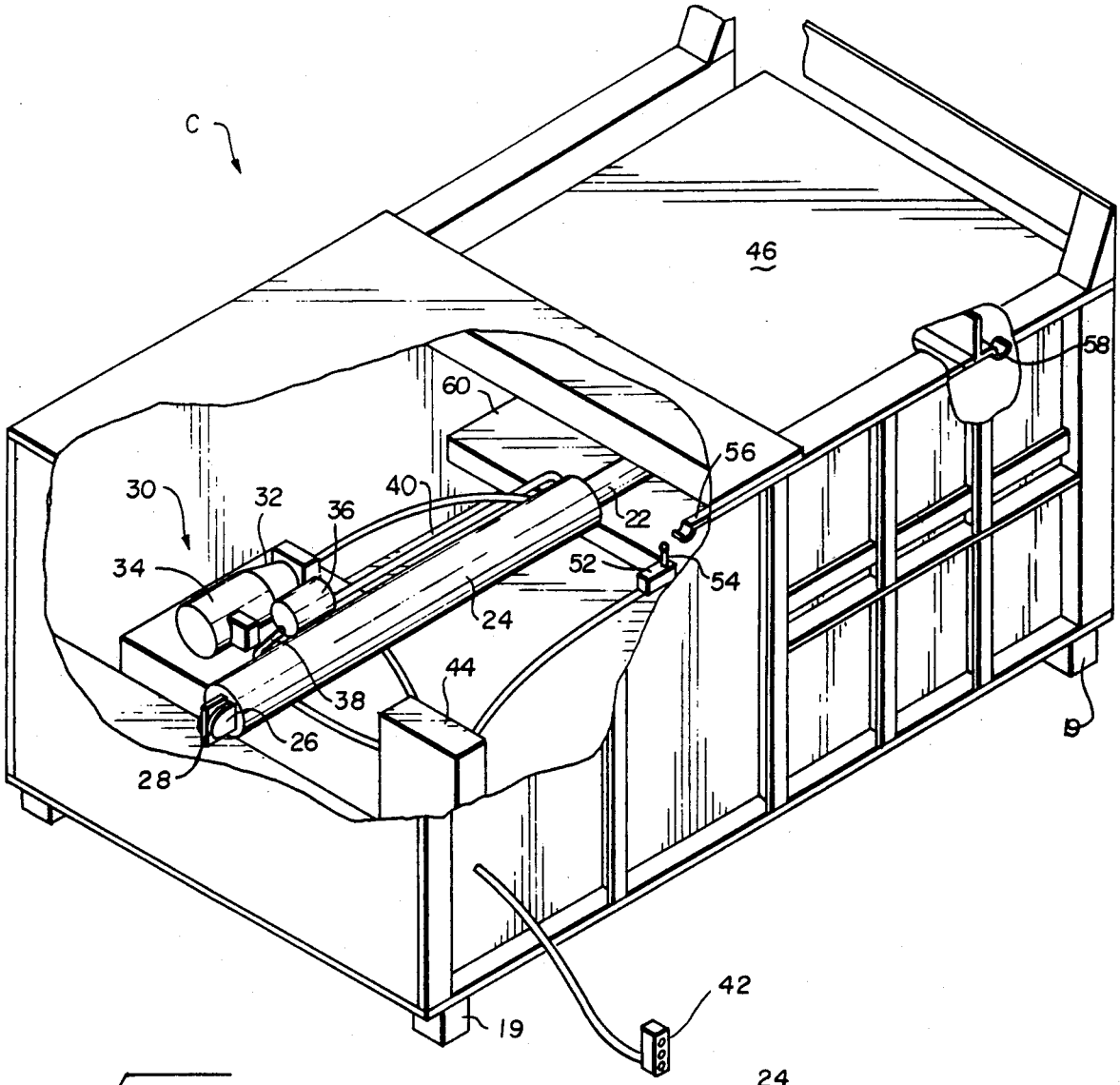
FIG. 1 is a perspective view with portions broken away disclosing the compactor unit of the invention.
Figure 4:
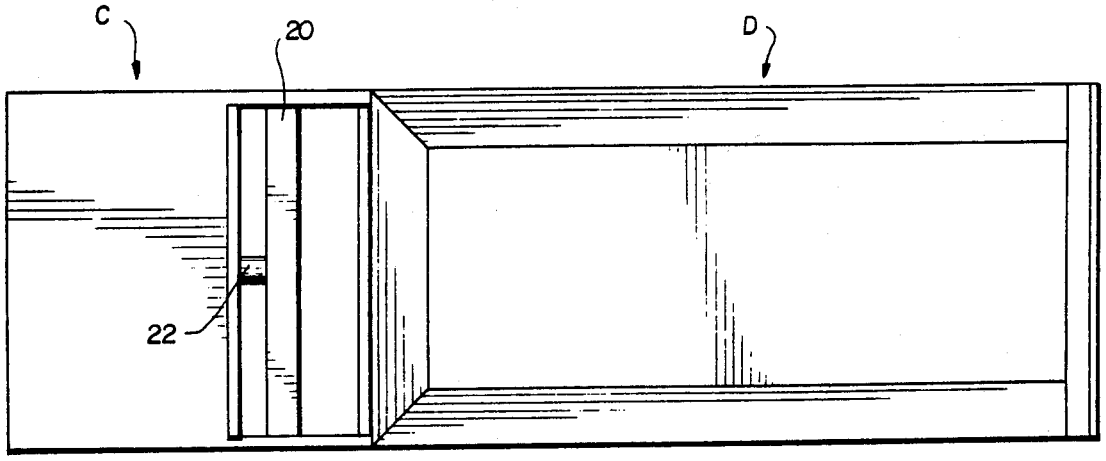
FIG. 4 is a top plan view of FIG. 3.

As best shown in FIGS. 1 and 3–4, compactor unit C includes a compactor ram 20 securely affixed to piston 22 of cylinder 24. Cylinder 24 includes ears 26 pivotally connected to support 28 affixed to the structural members across the end of the compactor C. Although support 28 is disclosed as being affixed to one wall of compactor unit C, those skilled in the art can appreciate that many other means for pivotally mounting a hydraulic cylinder to a body are known in the art.

Hydraulic power package 30 is mounted in compactor unit C and includes a hydraulic pump 32 connected to electric motor 34. Pump 32 has a fluid output of 4 to approximately 52 gallons per minute, with an output pressure of approximately 1000 lbs. per square inch (psi) to approximately 2200 psi, for reasons to be explained herein later.

Directional control valve 36, which includes a four-way solenoid valve, is in fluid communication with pump 32 by means well known in the art. Similarly, control valve 36 is in fluid communication with cylinder 24 by means of hydraulic hoses 38 and 40, each of which is adapted for extending piston 22 longitudinally toward or away from cylinder 24, as is well known. Push button control station 42 is in electrical communication with electrical control box 44 disposed in container unit C, and in electrical connection with power package 30, as is well known in the art. Preferably, control box 44 includes the circuit breakers, fuses and other electrical devices utilized in controlling the electrical apparatus.

As best shown in FIGS. 1 and 3, plate 46 is securely fastened to ram 20 along the upper surface thereof. Plate 46 acts as a sliding gate valve to prevent the transfer of waste from hopper 48, as best shown in FIG. 3, to compactor unit C. Hopper 48 temporarily holds and stores waste which is to be compacted. Plate 46 prevents the transfer of waste from hopper 48 to compactor unit C when the ram 20 is in its second, or extended waste-compacting position, as best shown in FIG. 1. Displacement of ram 20 rearwardly toward cylinder 24 causes plate 46 to unblock opening 50 in compactor unit C, which is aligned with hopper 48. The unblocking of opening 50 permits waste to flow from hopper 48 into the charge box B of compactor C ahead of ram 20. The ram 20 travels backwardly toward cylinder 24 to thereby permit the waste in the hopper 48 to be transferred into the compactor unit C so as to be ultimately transferred through aperture 16 into compactor container D.

As best shown in FIG. 1, switch 52, having a pivotal lever arm 54, is mounted in compactor unit C and is engageable with one of trip arms 56 and 58 secured to ram 20. Trip arm 56 trips lever arm 54 of switch 52 when the ram 20 is in its forward or waste compacted position and thereby indicates to control box 44 that the ram 20 is in its forward position. The trip arm 58 engages lever arm 54 of switch 52 when ram 20 is in its rearward or first position. The first position is associated with the transfer of waste from hopper 48 to compactor unit C. It can be noted in FIGS. 1 and 3 that a base 60 is disposed in compactor unit C and provides a bearing surface on which ram 20 slides as it moves between its first and second position.

Figure 2:
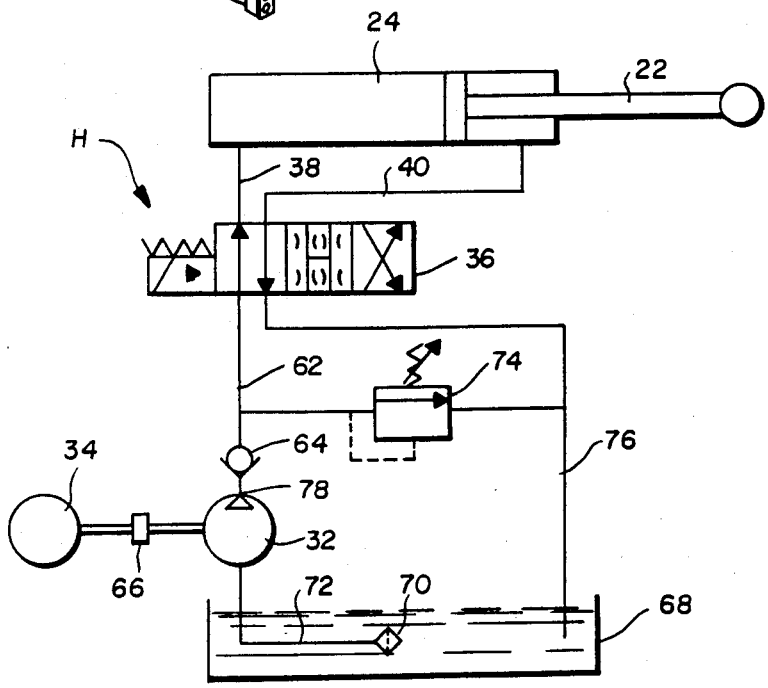
FIG. 2 is a schematic diagram of the hydraulic system of the invention.

The hydraulic control circuit H for operation of compactor unit C is disclosed in FIG. 2. Piston 22 and cylinder 24 are in fluid communication with hydraulic pump 32 by means of hydraulic supply lines or hoses 38 and 40. A single solenoid directional control valve 36 is in fluid communication with pump 32 by means of a hydraulic supply line 62 which communicates with pump 32 through check valve 64. Motor 34 is connected to pump 32 by hub coupling 66, in a way well known in the art. Reservoir 68 maintains a supply of hydraulic fluid, of a type well known in the art, which is communicated through filter 70 with pump 32 by means of line 72. Relief valve 74 is in fluid communication with line 62 and exhaust line 76 for decreasing the system pressure beyond a predetermined set point in order to prevent damage to the control system H.

It can be noted from FIG. 2 that the utilization of check valve 64 connected to the output 78 of pump 32 assures that the pressurized fluid may only flow toward cylinder 24 and piston 22 and not toward pump 32. This is particularly true during the pressure monitoring of the container D. The control valve 36 is controlled by switch 52 and directs the direction of displacement of piston 22. The check valve 64 assures, therefore, that the back pressure exerted by the compactor waste W will not cause pressurized fluid to flow backwardly through pump 32 and thereby lessens the possibility of system malfunction. The check valve 64 may be a ball check, a solenoid or other similar valve well known in the art.

Figure 5:
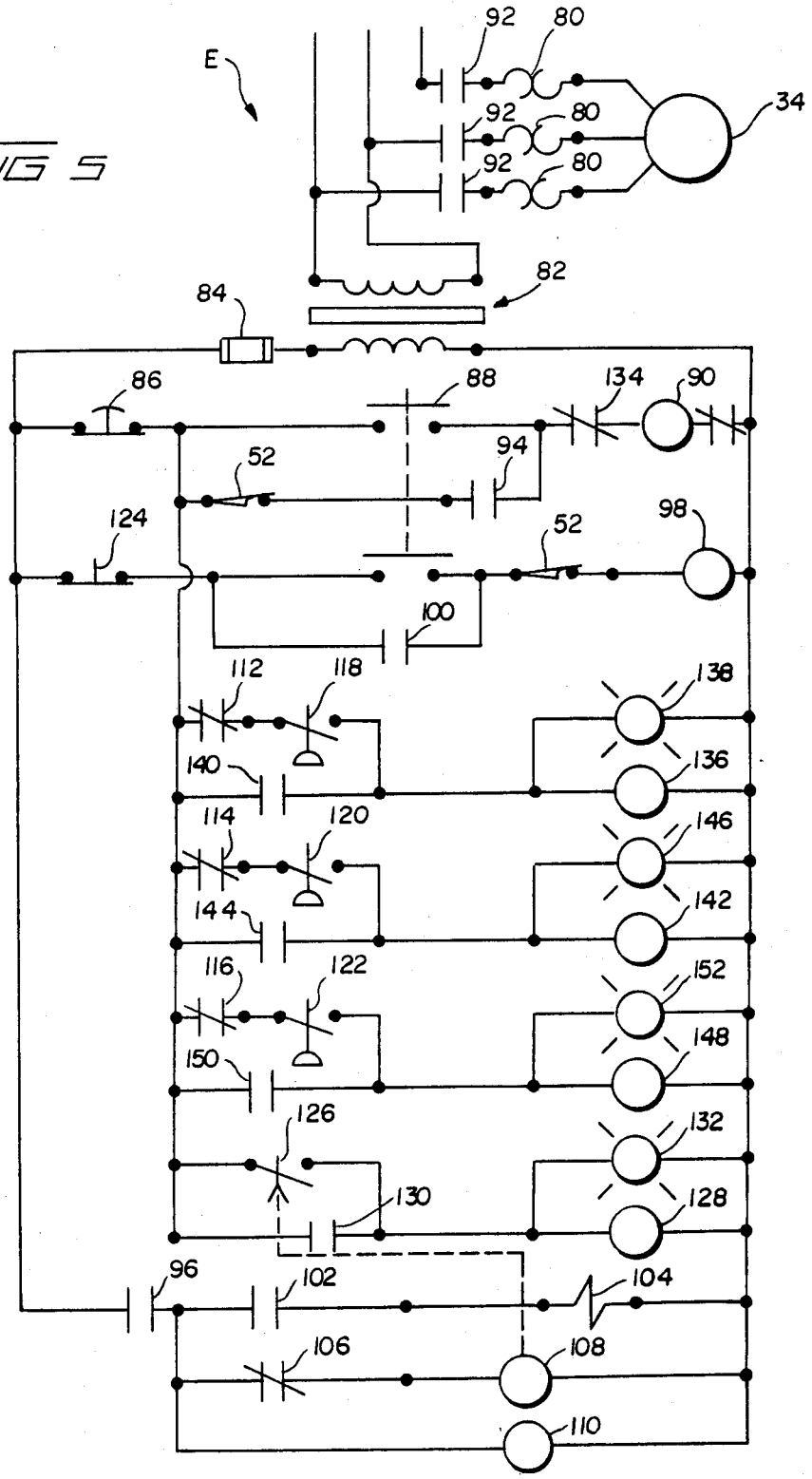
FIG. 5 is a functional schematic view of the control circuit of the invention.

The electrical control circuit E is best shown in FIG. 5. Naturally, circuit E is connected to a source of electric power (not shown). Motor 34 is protected by overloads 80, of a type well known in the art. Transformer 82 provides the control circuit, as herein explained, with the proper operating voltage, preferably 110 volts. Although a 110 volt operating voltage is disclosed, those skilled in the art can appreciate that higher voltage levels may be utilized with differently sized motors 34. Preferably, the control circuit E includes a fuse 84. Stop button 86 disposed in control box 44 is adapted for stopping motor 34 at any stage in the cycle by depressing button 86. Motor 34 is started by pressing start button 88 disposed in control box 44 which energizes starter coil 90 which in turn closes starter contacts 92. Pressing start button 88 also closes auxiliary motor starter contacts 94 and 96. Pressing start button 88 also energizes control valve 36 and relay 98 which closes the normally open relay contact 100 and thereby provides a locking circuit. Normally open relay contact 102 also closes, thereby energizing solenoid 104 which controls directional control valve 36.

Ram 20 moves away from container D toward cylinder 24 when the solenoid 104 is energized. Similarly, ram 20 moves toward container D, and thereby compresses the waste W when the solenoid 104 is deenergized. The solenoid 104, therefore, controls the direction of displacement of piston 22 by controlling valve 36 and thereby regulates the flow of hydraulic fluid from pump 32 to cylinder 24.

Normally closed relay contact 106 opens when solenoid 104 is energized and thereby prevents electrical current from energizing timing relay 108. Also energized by the closing of auxiliary motor starter contact 96 is relay 110 which also opens normally closed relay contacts 112, 114 and 116. Opening contacts 112, 114 and 116 prevents current from flowing to pressure actuated switches 118, 120 and 122 for so long as starter coil 90 is energized. It should be pointed out that each of switches 118, 120 and 122 is pre-set to close at a predetermined pressure level and that the switches 118, 120 and 122 are in fluid communication with cylinder 24 and thereby monitor the back pressure exerted by waste W.

Movement of ram 20 toward cylinder 24 in the charge box B of compactor unit C causes trip arm 54 to contact limit switch 52 and this breaks the circuit to relay 98. This opens the contacts 100 and 102 and closes contact 106. The push button 124 also cuts the current to relay 98. Opening contact 102 causes solenoid 104 to be deenergized and thereby shifts control valve 36 and reverses the direction of displacement of ram 20.

Closing contact 106 energizes timing relay 108. The timing relay may be of the adjustable type. Ram 20 continues to be displaced forwardly toward compactor container D until trip arm 56 engages limit switch 52. Should the ram 20 be unable to trip limit switch 52 during the presselected time, then the timing relay 108 will close the contact 126 and thus energize relay 128. Energizing relay 128 closes contact 130. Closing contact 130 causes the container full light 132 to be illuminated and to thereby signal that the container is full.

Energizing relay 130 also opens contact 134 and cuts power to starter coil 90. This causes the motor 34 to cease rotation and thereby causes the pump 32 to cease its output.

When power is cut to starter coil 90, then auxiliary contacts 94 will also open. Cutting power to relay 110 therefore causes contacts 112, 114 and 116 to close. Should pressure switch 118 sense pressure sufficient to make it close, then current will flow to relay 136 and thereby operate 70% full indicator light 138. Relay 136 closes contact 140 and thereby locks indicating lamp 138 in the on, that is the illuminated position. Consequently, the operator (not shown) will notice that the indicator lamp 138 is lit and will still realize that only approximately 30% of container D is still available.

Similarly, if the back pressure is high enough to close pressure switch 120 then relay 142 will close and contact 144 will also close and thereby lock 80% full indicating lamp 146 in the illuminated or on position. Finally, should the pressure be still higher then switch 122 will close and thereby close relay 148 and contact 150 thereby locking 90% full indicator lamp 152 in the illuminated position. Naturally, other percentages and fullness ranges for lamps 138, 146 and 152 are possible. Similarly, switches 118, 120 and 122 may actually be a single switch with multiple settings. The switch may be an electronic device with infinite settings. The switch could then feed a single sealed meter, in order to display the results.

As best shown in FIG. 3, pressure switches 118, 120 and 122 are mounted in control box 154. Switches 118, 120 and 122 are in fluid communication with cylinder 24 by means of hydraulic supply line 156. As has been previously explained, switches 118, 120 and 122 monitor the pressure of the fluid in cylinder 24 when the motor 34 is deenergized and the ram 20 is in the waste compacted position. Relays 136, 142, 148 and 128 are mounted in control cabinet 158 and are in electrical connection with switches 118, 120 and 122 by means of control line 160. Timing relay 108 is mounted within a control housing 162 which is in electrical connection with control cabinet 158, including the relay therein, by means of connection 164. Finally, indicator lamps 138, 146, 152 and 132 are mounted to indicator housing 166 and are in electrical connection with control cabinet 158 by means of connection 168.

One skilled in the art can appreciate that control box 154, control cabinet 158, control housing 162 and indicating housing 166 could all be integrated into a single control box in order to compactly locate the operating components of the compactor unit C.

OPERATION

When waste or refuse substantially fills hopper 48 then ram 20 should be cycled in order to clear the waste from hopper 48 and to transfer and compress the waste in container D. Normally, the ram 20 is disposed in its second, or waste-compacted position. Consequently, plate 46 blocks aperture 50 and prevents the waste in hopper 48 from falling into container unit C. Pressing start button 88 energizes the power package 30 and causes the ram 20 to be displaced rearwardly toward cylinder 24. This causes the plate 46 to unblock aperture 50 and permits the waste to fall into charge box B.

Engagement of lever arm 54 by trip arm 58 causes directional valve 36 to shift into the configuration of FIG. 2. This causes the piston 22 to be displaced forwardly, thereby causing the ram 20 to again approach the waste-compacted position. Displacement of the ram 20 toward the container unit D causes the plate 46 to again begin to block aperture 50 and thereby prevent further transfer of waste from hopper 48 to container unit C. When the ram 20 is in its waste-compacted position, then the control circuit E of FIG. 5 causes the motor 34 to be deenergized and thereby locks the ram 20 in its waste-compacted position. As has been previously described, pressure switches 118, 120 and 122 monitor the back pressure generated by the compacted waste W bearing against the ram 20. The pressure exerted by the compacted waste W is proportional to the amount of waste in the container D and thereby the illumination of any one of lights 138, 146, 152 and 132 allows the operator (not shown) to know how such room remains in the container D.

A particular advantage of the control circuit of FIG. 5 is that the pump 32 is adapted for increasing its output pressure in response to temporary partial blockages caused by non-compressable waste, such as boards. The power package 30 senses this blockage and increases the output pressure in order to clear the blockage. During this time the switches 118, 120 and 122 are deenergized and therefore they do not give a faulty indication that the container unit D is full. This permits, therefore, the blockages to be cleared without shutting down the power package 30. The timer relay 108 is, however, energized.

As has been previously described, when the ram 20 begins to be displaced toward the container unit D then the timer relay 108 is energized and monitors the time required for the ram to proceed from its first or waste receiving position to its second or waste compacted position. In the event that the ram 20 does not attain the waste compacted position in the alloted time, then the power package 30 is shut down and the container full light 132 is illuminated. This prevents damage to the unit and also prevents the container unit D from becoming overloaded.

While this invention has been described as having a preferred design, it is understood that is capable of further modifications, uses and/or adaptations to the invention following in general the principles of the invention and including such departures from the present disclosure as come within known or customay practice in the art to which the invention pertains and as may be applied to the central features herein before set forth, and fall within the scope of the invention of the limits of the appended claims.

What we claim is:

1. The method of monitoring the fullness of a compactor waste receiving container wherein a hydraulically operated cylinder and piston assembly displaces a ram for thereby compacting the waste, comprising the steps of:

(a) supplying said compactor with a quantity of waste to be compacted;

(b) displacing said ram for a waste-receiving position to a waste-compacted position whereby said quantity is transferred to said container and compacted therein;

(c) hydraulically locking said ram in said waste-compacted position and thereby preventing further displacement of said ram;

(d) monitoring the hydraulic pressure of said cylinder after locking said ram in said waste-compacted position whereby the pressure is proportional to the fullness of said container; and, (e) signaling said container fullness.

2. The method as defined in claim 1, including the step of:

(a) preventing further displacement of said ram when said ram fails to attain said waste compacting position in a pre-selected time period.

3. The method of operating a waste compactor having a movable compacting ram, comprising the steps of:

(a) supplying said compactor with a quantity of waste to be compacted;

(b) displacing said ram to a waste-compacted position;

(c) locking said ram in said waste-compacted position;

(d) monitoring the force exerted on said ram by the compacted waste after said ram is locked in said waste-compacted position; and, (e) indicating the force exerted on said ram by the compacted waste.

4. The method of claim 3, including the steps of:

(a) monitoring elapsed time during displacement of said ram; and, (b) ceasing displacement when said ram fails to attain said waste-compacted position in a predetermined period.

5. The method of claim 3, including the steps of:

(a) sensing blockage caused by incompressible waste during displacement of said ram; and, (b) increasing the force displacing said ram and clearing said blockage.

6. The method of claim 3, including the steps of:

(a) providing said ram with valve means preventing waste from being transferred to said compactor when said ram is in said waste-compacted position; and, (b) displacing said ram to a waste-receiving position permitting waste to be transferred to said compactor prior to displacement of said ram to said waste-compacted position.

7. The method of claim 6, including the step of:

(a) cycling said ram between said waste-compacted and waste-receiving positions.

8. The method of claim 3, including the steps of:

(a) comparing the force exerted on said ram when locked with a predetermined reference proportional to the fullness of said compactor; and, (b) indicating the fullness of said compactor.

9. The method of claim 3, including the steps of:

(a) displacing said ram to said waste-compacted position with a hydraulically operated cylinder and piston assembly;

(b) interrupting the flow of hydraulic fluid to said cylinder and piston assembly when said ram is in said waste-compacted position and thereby locking said ram in said waste-compacted position; and, (c) monitoring the back pressure on said cylinder and piston assembly while said ram is locked.

10. The method of claim 9, including the steps of:

(a) sensing blockage during displacement of said ram; and, (b) increasing the fluid pressure of the hydraulic fluid and thereby clearing said blockage.

11. A control method for a waste compactor, comprising the steps of:

(a) providing a compactor having a charging box and a container and a displaceable ram for transferring waste from said box to said container;

(b) providing hydraulic means for displacing said ram between a waste-receiving position and a waste-compacted position;

(c) supplying said charging box with a quantity of waste to be compacted;

(d) displacing said ram from said waste-receiving position to said waste-compacted position and thereby transferring the waste to and compacting the waste in said container;

(e) hydraulically locking said ram against further displacement when in said waste-compacted position;

(f) monitoring the back pressure of said hydraulic means exerted by the compacted waste on said ram after said ram is locked in said waste-compacted position;

(g) comparing the back pressure to a reference proportional to the fullness of said container; and, (h) indicating the fullness of said container.

12. The method of claim 11, including the steps of:

(a) monitoring the elapsed time during displacement of said ram; and, (b) ceasing displacement of said ram when the elapsed time exceeds a predetermined period.

13. The method of claim 11, including the steps of:

(a) providing said ram with valve means preventing transfer of waste to said charging box when said ram is in said waste-compacted position and permitting transfer of waste to said charging box when said ram is in said waste-receiving position; and, (b) displacing said ram to said waste-receiving position for transferring waste to said charging box.

14. The method of claim 13, including the steps of:

(a) providing said charging box with a hopper for holding a supply of waste; and, (b) cycling said ram between said waste-compacted and said waste-receiving positions while waste is held by said hopper.

15. The method of claim 11, including the steps of:

(a) sensing blockage during displacement of said ram from said waste-receiving to said waste-compacted position; and, (b) increasing the hydraulic pressure of said hydraulic means for clearing the blockage.

16. The method of claim 11, including the step of:

(a) visually indicating the fullness of said container.

* * * * *